US006088635A

United States Patent [19]

Cox et al.

[11] Patent Number: 6,088,635

[45] Date of Patent: Jul. 11, 2000

[54] RAILROAD VEHICLE ACCIDENT VIDEO RECORDER

[75] Inventors: Todd Cox; Chris Amet, both of Alpharetta; Mark McDougald, Woodstock; Duane A. Knight, Alpharetta; Cheuk Nam Yuen, Woodstock, all of Ga.

[73] Assignee: Roadtrac, LLC, Roswell, Ga.

[21] Appl. No.: 09/261,937

[22] Filed: Mar. 3, 1999

Related U.S. Application Data

[60] Provisional application No. 60/102,037, Sep. 28, 1998.

[51] Int. Cl.[7] ..... B61L 3/00

[52] U.S. Cl. ..... 701/19; 246/115; 246/167 R; 246/185; 340/438; 340/937; 701/35; 701/213

[58] Field of Search ..... 701/19, 29, 35, 701/70, 213; 340/937, 988, 989, 425.5, 436, 438; 307/9.1; 246/167 R, 114 R, 115, 114 A, 117, 122 R, 123, 185

[56] References Cited

U.S. PATENT DOCUMENTS

| | | |
|---|---|---|
| Re. 35,590 | 8/1997 | Bezos et al. . |
| 4,236,215 | 11/1980 | Callahan et al. . |
| 4,750,197 | 6/1988 | Denekamp et al. . |
| 4,754,465 | 6/1988 | Trimble . |
| 4,891,650 | 1/1990 | Sheffer . |
| 5,014,206 | 5/1991 | Scribner et al. . |
| 5,032,845 | 7/1991 | Velasco . |
| 5,103,459 | 4/1992 | Gilhousen et al. . |
| 5,131,612 | 7/1992 | Skantar . |
| 5,223,844 | 6/1993 | Mansell et al. . |
| 5,247,564 | 9/1993 | Zicker . |
| 5,299,132 | 3/1994 | Wortham . |
| 5,429,329 | 7/1995 | Wallace et al. . |
| 5,515,043 | 5/1996 | Berard et al. . |
| 5,515,285 | 5/1996 | Garrett, Sr. et al. . |
| 5,515,419 | 5/1996 | Sheffer . |
| 5,539,810 | 7/1996 | Kennedy et al. . |
| 5,544,225 | 8/1996 | Kennedy et al. . |
| 5,557,254 | 9/1996 | Johnson et al. . |
| 5,574,469 | 11/1996 | Hsu . |
| 5,636,122 | 6/1997 | Shah et al. . |
| 5,673,305 | 9/1997 | Ross . |
| 5,978,718 | 11/1999 | Kull ..... 701/19 |
| B1 5,043,736 | 9/1994 | Darnell et al. . |

FOREIGN PATENT DOCUMENTS

WO 89/1283 12/1989 WIPO .

OTHER PUBLICATIONS

Nov. 21, 1996—article "Miras Introduces GPS Vehicle Tracking Using The Internet".

Sep. 15, 1997—article "Vectorlink Launches Vehicle Tracking Service Via Internet".

*Primary Examiner*—William A. Cuchlinski, Jr.
*Assistant Examiner*—Edward Pipala
*Attorney, Agent, or Firm*—Needle & Rosenberg, P.C.

[57] ABSTRACT

A method and monitoring unit for recording the status of a railroad vehicle prior to a potential accident. In a monitoring unit mounted in or on a railroad vehicle, such as a locomotive, a video camera is provided to continuously view a scene that the railroad vehicle approaches. The monitoring unit continuously monitors the status of an emergency brake of the railroad vehicle and the status of a horn of the railroad vehicle. Video signals from the video camera are continuously stored. A control unit in the monitoring unit detects the application of both the emergency brake and blast of the horn within a predetermined time window. Video signals from the video camera are captured for a predetermined period of time after detecting that the application of the emergency brake and horn blast within the predetermined time window.

20 Claims, 5 Drawing Sheets

RAILROAD VEHICLE ACCIDENT VIDEO RECORDER

This application claims the benefit of U.S. Provisional Application No. 60/102,037 filed Sep. 28, 1998, entitled "System and Method for Capturing the Status of a Railroad Vehicle and Railroad Crossings."

BACKGROUND OF THE INVENTION

Railroad operators are responsible for activating a whistle prior to crossing each highway or road intersection. Frequently, in investigating railroad collisions, it is necessary to determine railroad vehicle speed at the time at which the emergency brake was applied and the location at which the emergency brake was applied, with respect to the railroad crossing or other obstacle in the railroad vehicle's path. Further, the investigation of a collision involving an object and a railroad vehicle at a railroad crossing requires information as to the status of the railroad crossing. That is, it is necessary to know whether the railroad crossing is unmarked, marked, signaled, or gated at the time of the accident to evaluate the means by which a motorist was (or was not) informed of an approaching railroad vehicle, and whether the motorist was prevented from crossing the tracks in front of the approaching railroad vehicle.

Currently, there is no existing technology that verifies whistle activation and records the vehicle speed, time and location of whistle activation as the railroad vehicle approaches the crossing. This information can be later recalled from an in-vehicle device via a direct connection, a removable memory card, or wireless transmission and stored in a permanent database for use in analysis. This information can concurrently be monitored and stored along with the horn activation data.

Likewise, there is currently no technology that allows for the capture and storage of the status of the railroad crossings. This information can be recalled from an in-vehicle device via a direct connection, a removable cassette, or wireless transmission and stored in a permanent database for use in an accident investigation analysis.

DETAILED DESCRIPTION OF THE DRAWINGS

Figure 1:
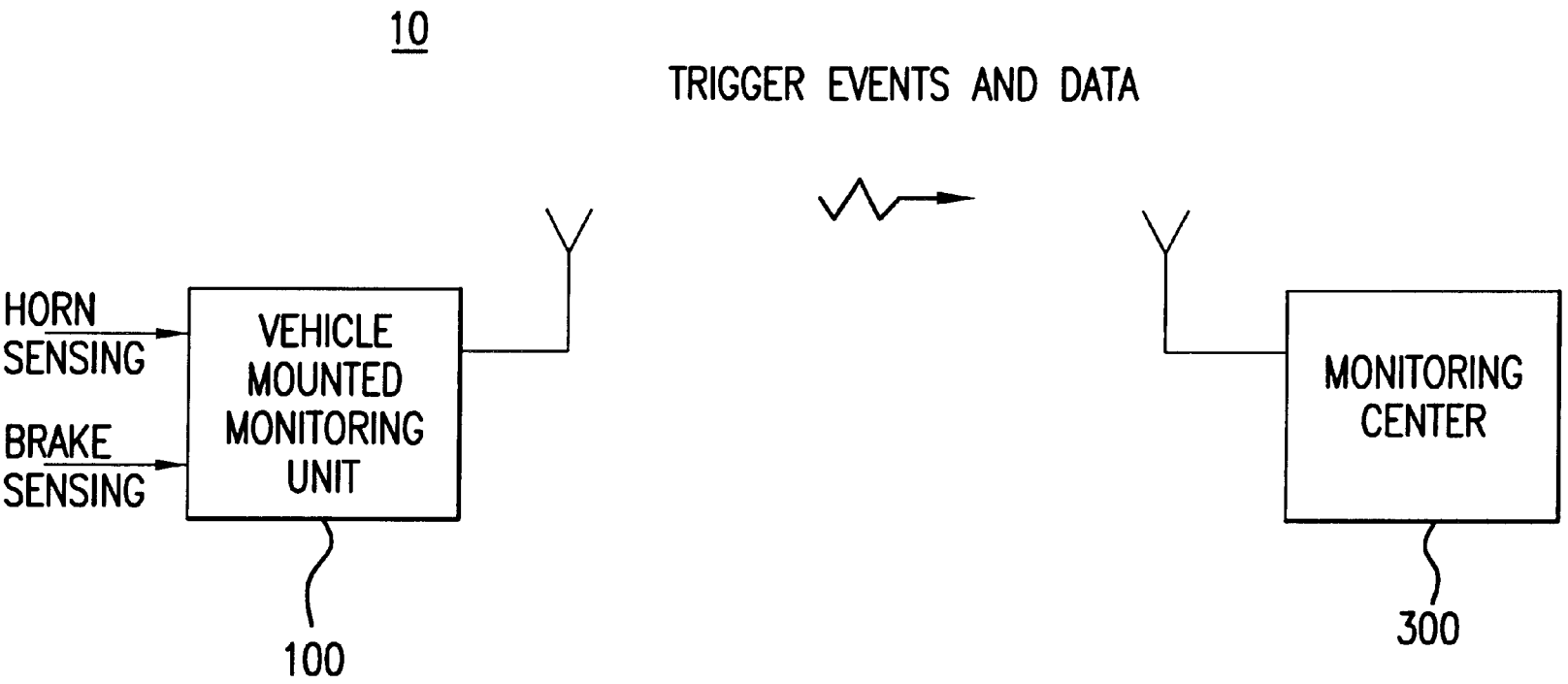
FIG. 1 is a block diagram of the system according to the present invention.

Referring first to FIG. 1, the system 10 according to the present invention comprises a vehicle mounted monitoring unit 100 and a monitoring center 300. The vehicle mounted monitoring unit 100 is designed to be mounted on a railroad vehicle and detect certain events associated with the railroad vehicle's approach and passage through a railroad crossing. To this end, the monitoring unit 100 senses application of the horn and application of the brakes on the railroad vehicle. The monitoring unit 100 continuously collects video information from a video camera positioned on the vehicle to view the approaching railroad crossing. When a condition is detected that is indicative of the railroad vehicle's approach to a railroad crossing or other important conditions, the monitoring unit 100 terminates recording of video information after a predetermined period of time has elapsed.

Figure 2:
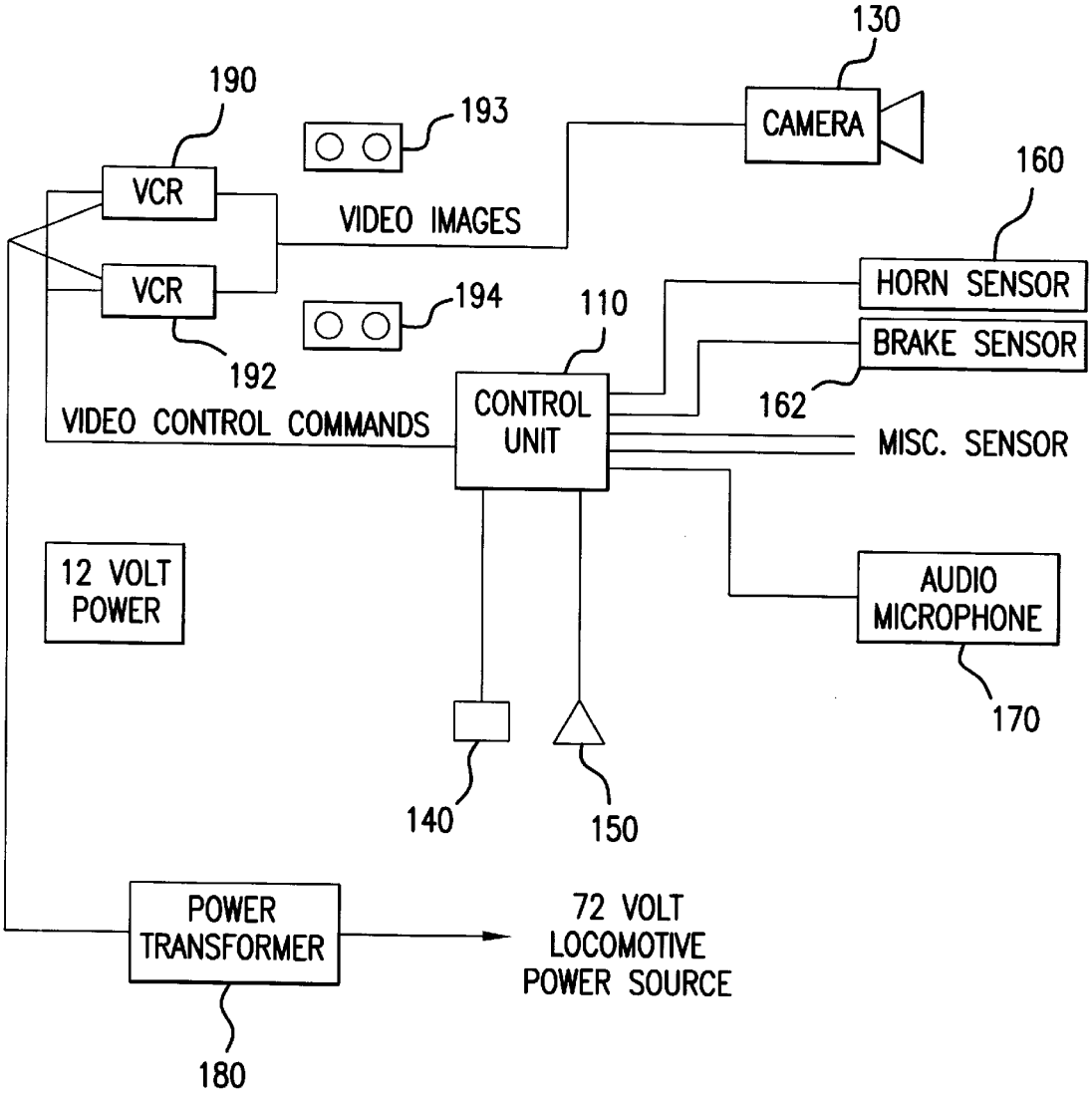
FIG. 2 is a block diagram illustrating the railroad vehicle mounted monitoring device in accordance with one embodiment of the present invention.

Turning to FIG. 2, the monitoring unit 100 according to a first embodiment is described. The monitoring unit 100 comprises a control unit 110, a video camera 130, a (global positioning system) GPS antenna 140, a wireless communications antenna 150, a horn sensor 162, a brake sensor 164, an audio microphone 170, a power transformer 180, and at least two video recording devices (VCRs) 190 and 192 each for storing video signals on a video tape 193 and 194, respectively.

The control unit 110 receives and processes all inputs to the monitoring unit 100 to generate appropriate output signals that are coupled to wireless antenna 150 for transmission to the monitoring center 300. Power to the monitoring unit 100 is supplied by the power transformer 180. The power transformer 180 connects to the power source of the railroad vehicle, such as a 72 volt locomotive power source, and steps down the voltage to a suitable level, such as 12 volts for use by the various components of the monitoring unit 100.

The video camera 130 is mounted on the railroad vehicle so as to capture realtime video images of a railroad crossing as the railroad vehicle approaches and passes through the crossing, including the activity of other vehicles at or around the railroad crossing. If necessary, more than one video camera may be provided. It is important that the video camera capture a sufficient scope of the scene to determine whether what occurs at a railroad crossing, that is, whether the crossing is properly marked, whether a motorist breached a gated crossing, etc.

Two VCRs 190 and 192 are provided because video signals from the video camera 130 are continuously recorded. The VCRs 190 and 192 both record simultaneously, but record to video tapes of differing length. The VCRs 190 and 192 will require re-winding at different times, thereby off-setting the times they will require re-winding. When the tape in one VCR runs out it can be re-wound, and recording is still occurring on the other VCR. As a result, there will always be sufficient video tape available to continuously record video signals collected from the video camera 130. The video signals are recorded over previously recorded information until the VCRs 190 and 192 are locked down (recording terminated), as explained hereinafter. Once the VCRs 190 and 192 are locked down, they will not continue recording until they are reset manually or electronically by the control unit 110.

The horn sensor 160 may comprise an electrical connection to the horn switch on the railroad vehicle to detect when the horn is actuated. The brake sensor 164 may comprise an electrical connection to the brake actuator on the railroad vehicle to detect when the emergency brake has been applied.

Miscellaneous other sensors may be included. For example, a vehicle speed sensor may be provided that electrically connects to an electronic speedometer on the railroad vehicle (if one exists) to continuously supply vehicle speed information.

Figure 3:
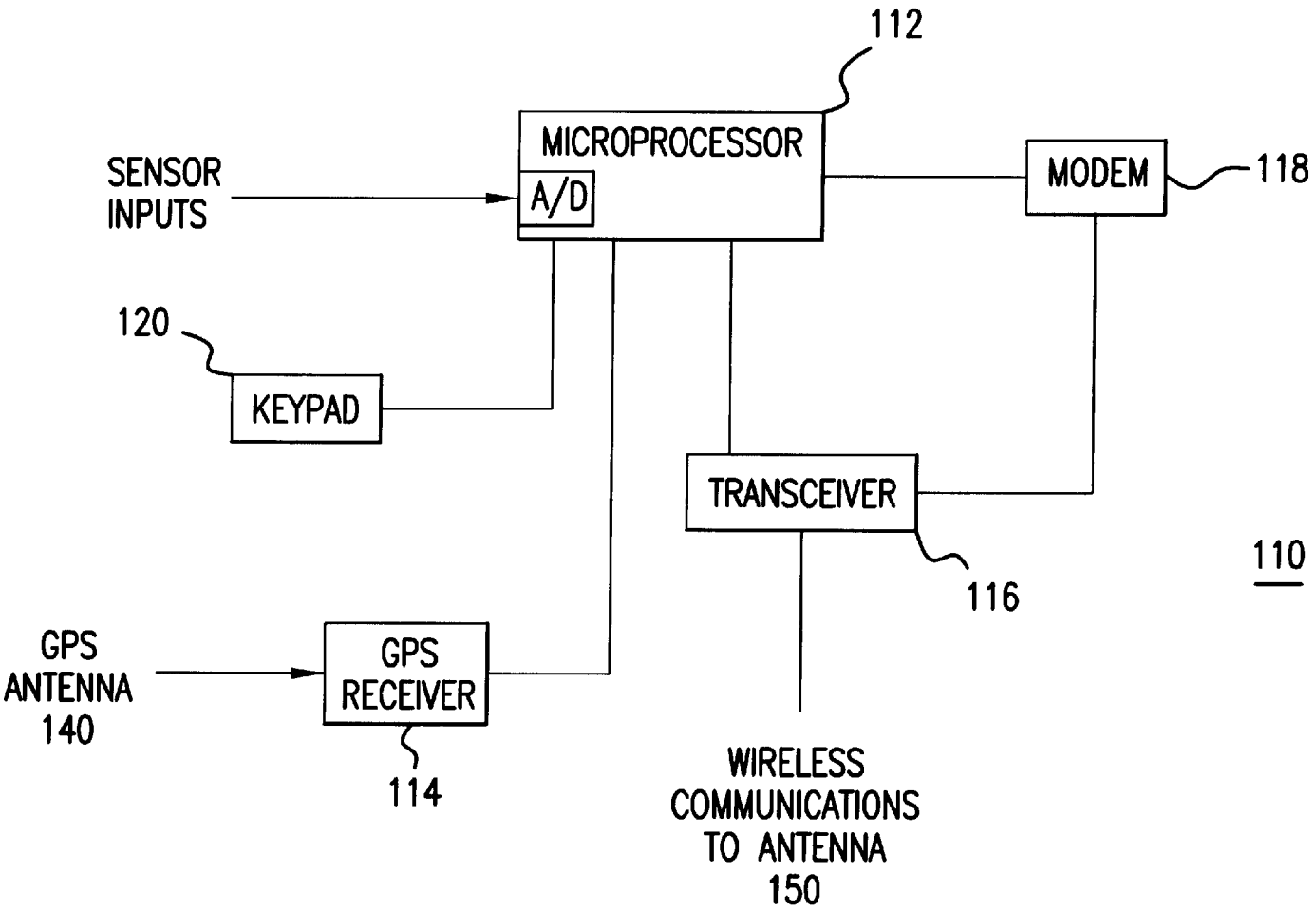
FIG. 3 is a block diagram of the control unit of the monitoring device shown in FIG. 1.

The control unit 110 is shown in greater detail in FIG. 3. The control unit 110 comprises a microprocessor 112 or other similar programmable processor device, a GPS receiver 114, a wireless communications transceiver 116, a modem 118 and a keypad 120. The microprocessor 112 may include an onboard analog-to-digital (A/D) converter that receives the analog input signals from the sensors 160, 162 and 164, and converts them to digital signals (if they are not already in digital format) for processing. A control program is stored in a memory device, such as a RAM or ROM associated with the microprocessor 112. The transceiver 116 is a cellular transceiver, for example, that is suitable for establishing a wireless connection to the monitoring center 300 or other remotely located station. The modem 118 modulates the status information for transmission by wireline or wireless link to the monitoring center 300.

The GPS receiver 114 receives and processes GPS signals detected by the GPS antenna 140 so that the exact position of the railroad vehicle can be determined at any time. The GPS receiver 114 is an optional component of the control unit 110 and is used when it is desired to capture time and location information associated with an event.

Figure 4:
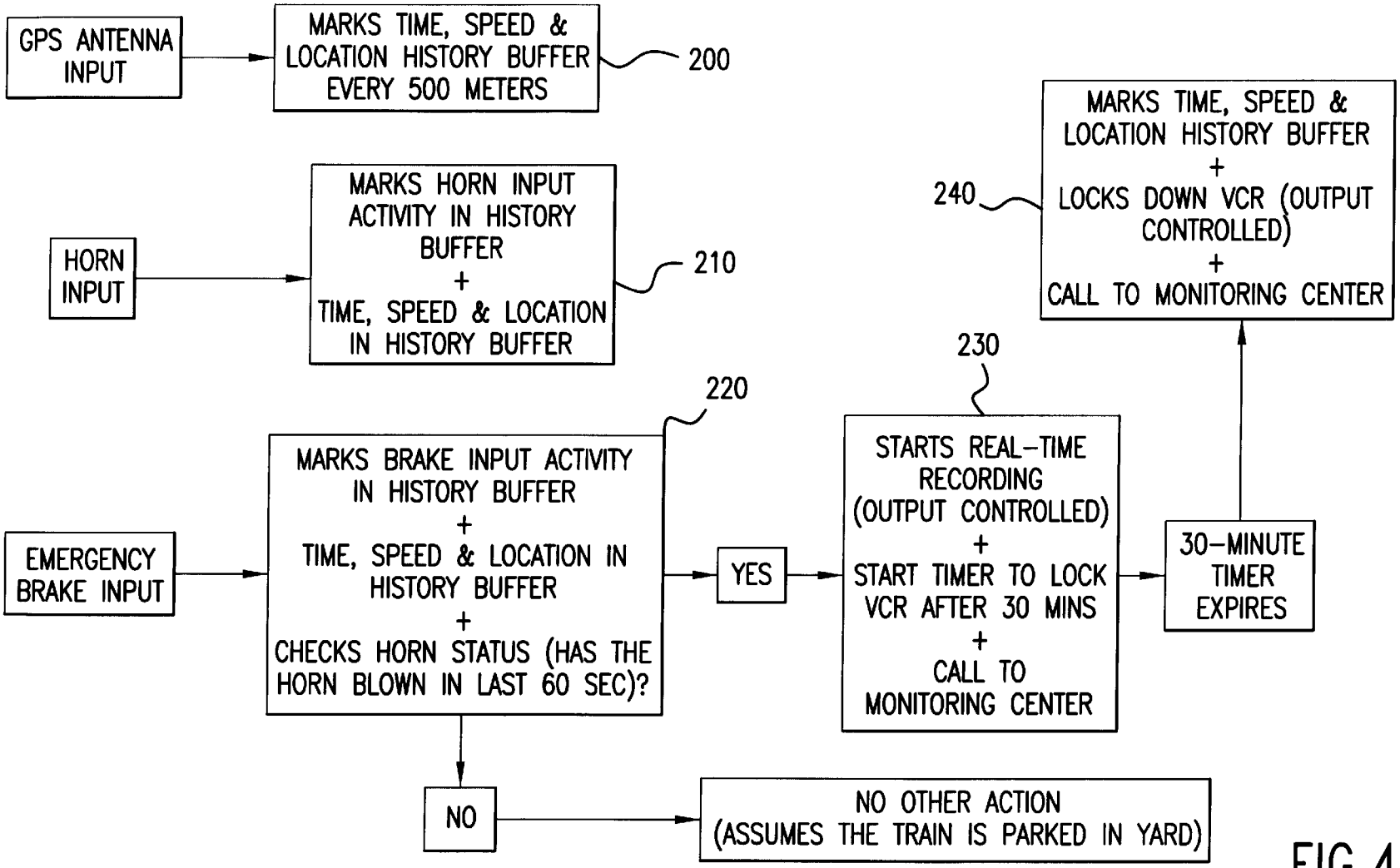
FIG. 4 is a flow chart showing the monitoring method according to the present invention.

Turning to FIG. 4, the operation of the monitoring unit 100 will be described. If the form of the monitoring unit employed includes GPS capability, The positional information of the railroad vehicle is continuously updated from the GPS receiver and stored on a periodic basis. This is shown in step 200. For example, the GPS location information is sampled every 500 meters. The control unit 110 updates the time, vehicle speed and GPS location in a first history buffer (in a working memory of the microprocessor 112) at each sampling event. The vehicle speed is obtained either from a vehicle speed sensor or derived from consecutive samples of GPS location information.

In step 210, the railroad vehicle horn input is sensed via the horn sensor 160, and if a horn is detected, the control unit 110 registers it appropriately in a second history buffer and also marks the first history buffer so that the horn occurrence can be associated with the time, speed and location of the railroad vehicle.

In step 220, the status of the emergency brake is sensed via the brake sensor 162. If it is determined that the emergency brake is applied, the control unit 110 marks it appropriately in a third history buffer and also marks the first history buffer so that the brake occurrence can be associated with the time, speed and location of the railroad vehicle. In addition, the control unit 110 checks the status of the second history buffer to determine whether the horn was blown within a predetermined time window of the brake detection event, such as for example, 60 seconds. If the horn was blown during this predetermined time window, this is indicative that the railroad vehicle was approaching a railroad crossing (because train operators are supposed to blow the horn when approaching a crossing to alert nearby motorists) or some other obstacle potentially in the path of the railroad vehicle.

Thus, the detection of the application of the emergency brake and the detection of the blast of the railroad vehicle horn (within a predetermined period of time of the emergency brake) is indicative of a potential accident and it is flagged as a detection or alarm event. During this time, the VCRs 190 and 192 are continuously recording video of the scene. When this potential accident condition is detected, a timer in the microprocessor 112 is started and the microprocessor 112 locks down (terminates recording by) the VCRs 190 and 192 after a predetermined period of time set by the timer has elapsed (to prevent further recording of video over the critical video recorded at the time of the event). For example, the timer may last 30 minutes, after which the microprocessor 112 stops recording of the VCRs 190 and 192. In addition, the microprocessor 112 transmits (via a cellular link, for example) an alarm message to the monitoring center 300. When a connection is established between the monitoring center 300 and the monitoring unit 100, the monitoring center 300 may open a connection with the audio microphone 170 in the monitoring unit 100 to listen to and record audio in the cockpit of the railroad vehicle. The alarm message to the monitoring center 300 may optionally contain GPS time and location information of the railroad vehicle at the time the event is detected.

After the expiration of the timer, in step 240, the control unit 110 marks the time, speed and location (if this information is obtained) in the history buffer and locks down (turns off) the VCRs 190 and 192 that were recording when the detection event occurred. The control unit 110 may cause another call to be made to the monitoring station. Once the VCRs are locked down, access to the video tape in the VCRs 190 and 192 is restricted. For example, the entire monitoring device 100 may be contained in a secure "box", access to which is restricted to only certain railroad agents with a special key or code that may be entered via the keypad 120 (in which case the keypad would be externally accessible from the box). The video information captured by the VCRs 190 and 192 will reveal the activity as viewed by the video camera that prior to, during and after the event that necessitated the blowing of the horn and the application of the railroad vehicle brakes. This information can then be used to assess the true cause(s) of an accident at that time, if one should occur.

The first, second and third history buffers referred to above are memory elements internal to the control unit 110, to which the control unit 110 writes appropriate information. Alternatively, a single history buffer of suitable size and fields may be employed for all of the monitored information.

If in step 220, it is determined that the railroad vehicle horn was not blown within the last 60 seconds since the emergency brake was applied. If this is the case, then no further action is taken, and it is assumed that the train is not facing a potential accident situation. The VCRs 190 and 192 will continue recording.

Figure 5:
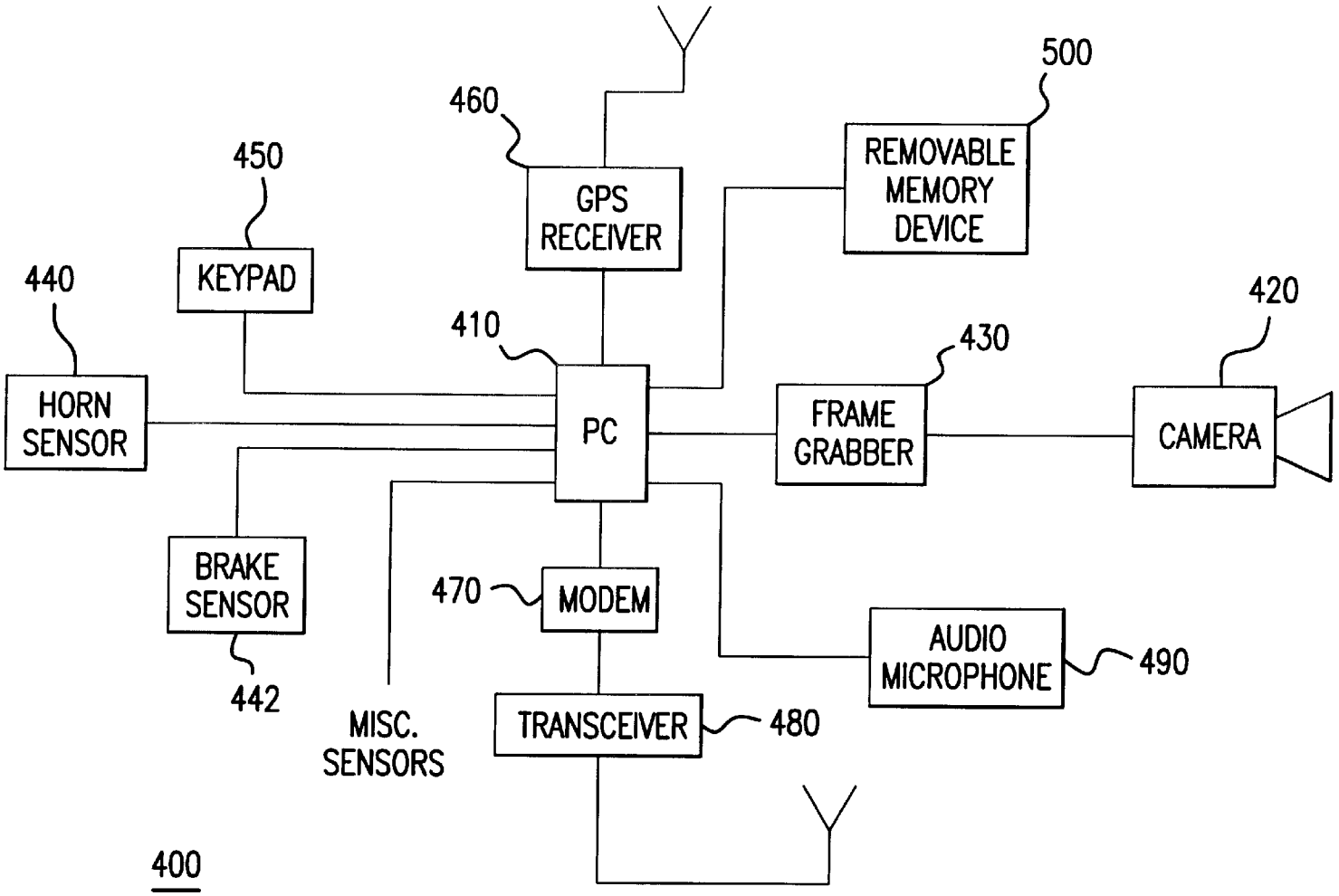
FIG. 5 is a block diagram illustrated the railroad vehicle mounted monitoring unit according to an alternative embodiment of the present invention.

Turning to FIG. 5, a monitoring unit 400 according to another embodiment of the present invention is shown. The monitoring unit 400 is a fully digital version of the monitoring unit 100. A personal computer (PC) 410 is the heart of the monitoring unit 400. Video signals obtained by a video camera 420 are coupled to a frame grabber 430 which digitizes the video signals (segments them into frames) and outputs the digitized video to the PC 410 for storage in random access memory (RAM) in the PC 410. Sensors, such as horn sensor 440 and brake sensor 442 are provided and are similar to those shown in the monitoring unit 100 of FIG. 1. In addition, the monitoring unit 400 comprises a keypad 450, optional GPS receiver 460, modem 470, transceiver 480, audio microphone 490 and a removable memory device 500. Many of these components have the same function as their counterparts shown in FIG. 1.

The removable memory device 500 may be a hard disk drive, a portable hard disk drive (such as a Zip™ drive), a large RAM memory module, etc. The memory device 500 is a back-up storage for the status information that is collected and stored by the PC 410 of the monitoring unit 400. In particular, the time, location, speed, horn status, brake status, video information and other sensor information of the railroad vehicle may be stored on the memory device 500. The memory device 500 may be "removable" from the monitoring unit 400. For example, the hard disk drive, portable hard disk drive or RAM memory module is of the type that can be readily removed from a port or slot associated with the PC 410.

The operation of the monitoring unit 400 is similar to the monitoring unit 100 with a few exceptions. The video information obtained by the camera 420 is digitized and continuously stored in RAM of the PC 410. A certain portion of the PC's RAM will be allocated to continuous video storage and information will be continuously stored (and written over previously stored video information). The PC 410 will detect activity from the horn and brake sensor 440 and 442 and lock down (terminate) the storage of incoming video information after a predetermined period of time set by a timer in the PC 410. This is similar to the VCR lock down operation described above, except that the PC can do this digitally in order to capture video information for a predetermined period of time associated with a railroad crossing (potential accident) event. Consequently, the RAM of the PC 410 will contain the video information of the scene for a period of time before, during and after the activity which necessitated the blowing of the horn and application of the railroad vehicle brakes. When an event is detected, the PC 410 stores GPS location (if GPS capability is provided in the monitoring unit 400) and other information and transmits this information via the transceiver 480 the monitoring center. As explained above, the monitoring center may open an audio link to the audio microphone 490 to listen to sounds in the railroad vehicle cockpit. In the digital version of the monitoring unit shown in FIG. 5, it may not be necessary to terminate the recording of the video information if sufficient memory is available on the PC 410 so as not to be considered with overwriting important video information.

The foregoing description illustrates an example of the operation of the system and method according to the present invention. It should be understood that other operations and features may be included. For example, audible sounds within the train operator's cockpit may be monitored on a continuous basis to record any statements made by the operator that may be useful in determining the cause of an accident. Moreover, video images taken by the camera 130 may be continuously stored and overwritten on the video tape in predetermined time increments. Alternatively, the video images may be digitally captured and digitally stored in a suitable video memory device, and overwritten in predetermined time increments. In the event a sudden change in acceleration is detected by the collision sensor (assuming that the emergency brake was never timely applied), the VCRs 190 and 192 are locked down as described above (to retain the last predetermined amount of video prior to the event) or the video memory is no longer overwritten to likewise save a predetermined amount of video prior to the event.

In summary, the present invention is directed to a system and method for recording the status of a railroad vehicle and the railroad crossing as a railroad vehicle approaches a crossing. The time, location and speed of the railroad vehicle is continuously stored. The status of the railroad vehicle is used to trigger when to stop recording information. The status of the horn and emergency brake are monitored. Detection of a horn blast coupled with (within a predetermined period of time of) the application of the emergency brake of the railroad vehicle triggers real-time storage of video images taken by a camera on the vehicle that is viewing the scene that the railroad vehicle is approaching. The recording/storage of the video images are locked down at the expiration of a predetermined period of time in order to prevent unauthorized access to the information, thereby preserving it for later review during an accident investigation, if one is necessary. In addition, the vehicle time, location, speed horn status, brake status, and other sensor status information are stored on a memory device that can be retrieved or accessed. The data on the memory device provides a comprehensive history of the time, speed and location as sensor events to enable determination as to whether the railroad vehicle was properly operated in response to certain conditions. That is, in can be determined whether a horn was properly and timely blown and/or whether an emergency brake was properly and timely applied before an accident or potential accident occurred. Alternatively, the video and/or other vehicle status information recorded by the monitoring device 100 may be transmitted to a remote monitoring center by way or a wireline or wireless link.

The above description is intended by way of example only and is not intended to limit the present invention in any way except as set forth in the following claims.

What is claimed is:

1. A method for visually recording a potential accident of a railroad vehicle, comprising steps of:

(a) continuously monitoring the status of an emergency brake of the railroad vehicle;

(b) continuously monitoring the status of a horn of the railroad vehicle;

(c) continuously viewing with a video camera the scene that the railroad vehicle approaches;

(d) continuously storing video information from the video camera;

(e) detecting at least, the application of both the emergency brake and blast of the horn within a predetermined time window; and (f) capturing video information from the video camera for a predetermined period of time after detecting that, at least, the application of the emergency brake and horn blast occurred within the predetermined time window.

2. The method of claim 1, and further comprising the step of storing the time and location of the railroad vehicle when detection in step (e) is made.

3. The method of claim 2, and further comprising the step of wirelessly transmitting to a monitoring center the time and location of the railroad vehicle associated with the detection made in step (e).

4. The method of claim 2, wherein the step of continuously monitoring the time and location of the railroad vehicle comprises continuously receiving global positioning satellite (GPS) signals and generating time and location information therefrom.

5. The method of claim 1, wherein the step of continuously storing video information from the video camera comprises recording video signals from the video camera simultaneously on first and second video tapes.

6. The method of claim 5, and further comprising the steps of rewinding the first video tape once its end is reached while recording video signals on the second video tape, and rewinding the second video tape once its end is reached while recording video signals on the first video tape.

7. The method of claim 1, wherein the step of continuously storing video information from the video camera comprises digitizing the video signals and storing them in memory of a personal computer.

8. A data recorder for use on a railroad vehicle comprising:

(a) an emergency brake sensor for detecting the application of an emergency brake on the railroad vehicle;

(b) a horn sensor for detecting the application of a horn of the railroad vehicle;

(c) a video camera suitable for mounting on the railroad vehicle to view the scene that the railroad vehicle approaches and continuously generate a video signal;

(d) a video recording device coupled to the video camera for storing the video signal output by the video camera; and (e) a control unit coupled to, at least, the emergency brake sensor, horn sensor, and video recording device, the control unit detecting, at least, the application of the emergency brake and blast of the horn within a predetermined time window and in response thereto generating a signal to cause the video recording device to record the video signal for a predetermined period of time, and at the expiration of the predetermined period of time, terminating recording by the video recording device.

9. The data recorder of claim 8, wherein the emergency brake sensor comprises a connection between the control unit and an emergency brake switch in the railroad vehicle, and the horn blast sensor comprises a connection between the control and a horn switch in the railroad vehicle.

10. The data recorder of claim 8, wherein the video recording device comprises first and second VCRs each for simultaneously recording the video signal on first and second video tapes, respectively.

11. The data recorder of claim 10, wherein the first VCR records video signals on a first video tape and the second VCR records on a second video tape, wherein the first video tape and second video tape have different lengths, and wherein the control unit controls the first VCR to rewind the first video tape once its end is reached while recording video signals on the second video tape, and controls the second VCR to rewind the second video tape once its end is reached while recording video signals on the first video tape.

12. The data recorder of claim 8, and further comprising a global positioning system (GPS) receiver for receiving GPS signals and generating time and location information of the railroad vehicle.

13. The data recorder of claim 12, wherein the control unit is connected to the GPS receiver and stores time and location information associated with the detection of the application of the emergency brake and horn blast within the predetermined time window.

14. The data recorder of claim 13, and further comprising a wireless transceiver connected to the control unit, and wherein the control unit transmits an alarm message including time and location information to a monitoring center via the wireless transceiver.

15. A data recorder for use on a railroad vehicle comprising:

(a) an emergency brake sensor for detecting the application of an emergency brake on the railroad vehicle;

(b) a horn sensor for detecting the application of a horn of the railroad vehicle;

(c) a video camera suitable for mounting on the railroad vehicle to view the scene that the railroad vehicle approaches and continuously generate a video signal;

(d) a frame grabber connected to the video camera for continuously digitizing the video signal; and (e) a control unit coupled to, at least, the emergency brake sensor, horn sensor, and frame grabber, the control unit detecting, at least, the application of the emergency brake and blast of the horn within a predetermined time window and in response thereto continuing to capture video information from the frame grabber for a predetermined period of time after the detection.

16. A method for visually recording a potential accident of a railroad vehicle, comprising steps of:

(a) monitoring the status of an emergency brake of the railroad vehicle;

(b) monitoring the status of a horn of the railroad vehicle;

(c) detecting, at least, the application of both the emergency brake and blast of the horn within a predetermined time window; and (d) capturing video information from a video device that view a scene that the railroad vehicle approaches, the video information captured for a predetermined period of time after detecting that, at least, the application of the emergency brake and horn blast occurred within the predetermined time window.

17. The method of claim 16, and further comprising the step of storing the time and location of the railroad vehicle when detection in step (c) is made.

18. The method of claim 17, and further comprising the step of wirelessly transmitting to a monitoring center the time and location of the railroad vehicle associated with the detection made in step (c).

19. The method of claim 16, wherein the step of capturing video information from the video device comprises recording video signals on a video camera.

20. The method of claim 17, wherein the step of monitoring the time and location of the railroad vehicle comprises continuously receiving global positioning satellite (GPS) signals and generating time and location information therefrom.

* * * * *